US007484724B2

(12) United States Patent
Yamanaka et al.

(10) Patent No.: US 7,484,724 B2
(45) Date of Patent: Feb. 3, 2009

(54) RECORDING-MEDIUM RETURNING MECHANISM AND A RECORDING APPARATUS INCLUDING THE SAME, AND MEDIUM-RETURNING MECHANISM AND A LIQUID EJECTION APPARATUS INCLUDING THE SAME

(75) Inventors: Tsuyoshi Yamanaka, Nagano-ken (JP); Yuji Miyamoto, Nagano-ken (JP); Miwa Shimizu, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 447 days.

(21) Appl. No.: 10/854,804

(22) Filed: May 27, 2004

(65) Prior Publication Data

US 2005/0017434 A1 Jan. 27, 2005

(30) Foreign Application Priority Data

Jul. 25, 2003 (JP) ..... 2003-201624

(51) Int. Cl.
*B65H 3/52* (2006.01)

(52) U.S. Cl. ..... 271/121; 271/122; 271/124

(58) Field of Classification Search ..... 271/121, 271/122, 124
See application file for complete search history.

(56) References Cited

U.S. PATENT DOCUMENTS 5,316,285 A * 5/1994 Olson et al. ..... 271/122
5,655,762 A * 8/1997 Yergenson ..... 271/121
6,059,281 A * 5/2000 Nakamura et al. ..... 271/119
6,217,017 B1 * 4/2001 Yamazaki ..... 271/121
6,877,737 B2 * 4/2005 Yanagi et al. ..... 271/121
6,877,738 B2 * 4/2005 Sonoda et al. ..... 271/121

FOREIGN PATENT DOCUMENTS

JP 10-279104 A 10/1998
JP 2001-322729 A 11/2001
JP 2002-332130 A 11/2002
JP 2003-26349 A 1/2003

* cited by examiner

*Primary Examiner*—David H Bollinger
(74) *Attorney, Agent, or Firm*—Sughrue Mion, PLLC

(57) ABSTRACT

A recording-medium returning mechanism includes: a feed roller, provided to a feed-roller shaft that can be rotated, for coming into contact with a recording medium and feeding it; a hopper including a holder for holding a plurality of recording media stacked, the hopper being located at a position allowing the recording media on the holder to come into contact with the feed roller while being pressed against the feed roller and a position moving the recording media on the holder away from the feed roller; a separator for separating an uppermost recording medium on the holder from another recording medium simultaneously fed with the uppermost recording medium; and a return lever for returning the other recording medium to the holder.

4 Claims, 10 Drawing Sheets

RECORDING-MEDIUM RETURNING MECHANISM AND A RECORDING APPARATUS INCLUDING THE SAME, AND MEDIUM-RETURNING MECHANISM AND A LIQUID EJECTION APPARATUS INCLUDING THE SAME

This patent application claims priority from a Japanese patent application No. 2003-201624 filed on Jul. 25, 2003, the contents of which are incorporated herein by reference.

BACKGROUND OF THE INVENTION

1. Field of the Invention

The present invention relates to a feed mechanism for taking out one of a plurality of sheets of recording paper that are stacked and transferring that one sheet, and a recording apparatus including such a feed mechanism.

Moreover, the present invention relates to a liquid ejection device such as an ink-jet recording apparatus, which has the above feed mechanism and performs liquid ejection onto a medium by emitting liquid such as ink, from its head.

The liquid ejection apparatus in the present application means a recording apparatus which uses an ink-jet type recording head and achieves printing on the recording medium by emitting ink from the recording head, such as a printer, a copier and a facsimile machine, as well as an apparatus which uses a liquid ejection head corresponding to the ink-jet type recording head and emits liquid suitable for an application of the apparatus in place of the ink from the ink ejection head to a medium, thereby causing the liquid to adhere to the medium.

Examples of such a liquid ejection head include a color-material ejection head used in fabrication of color filters for a liquid crystal display or the like, an electrode-material (conductive paste) ejection head used in formation of electrodes for an organic EL display or a field emission display (FED), a biological organic material ejection head used in fabrication of bio-chips, and a sample ejection head as a precise pipette, other than the aforementioned recording head.

2. Description of the Related Art

Conventionally, there are known various structures for preventing simultaneous transfer of two or more sheets of paper in a feed mechanism, as described in Japanese Patent Applications Laying-Open Nos. 2002-332130 and 2003-26349, for example.

According to the structure described in Japanese Patent Application Publication No. 2002-332130, in order to provide sheet feed mechanism that does not cause the increase of the size of the device and the large increase of the cost and includes a simultaneous-transfer preventing mechanism having a simple structure, a lever protrusion extending from one end face of a rotation shaft that is formed integrally with are turn lever is inserted into a concave arc-shaped notch formed in a control cam, in such a manner that the lever protrusion can move within that notch in a radial direction. By the contact of this lever protrusion with the first contact face and second contact face of the notch, a relative rotation angle between the rotation shaft and the control cam is limited. While a feed operation has been completed yet and a trailing end of a sheet remains inside the sheet feed mechanism after a part in the main body of a recording apparatus or the like holds that sheet, that sheet pushes the return lever to rotate it toward a particular direction, thereby moving the return lever away from a transfer path of the sheet.

On the other hand, Japanese Patent Application Publication No. 2003-26349 discloses the following structure in order to prevent the simultaneous transfer without using a complicated mechanism or control, as well as the increase of the time required for the feed operation. In this operation, a return-lever control cam for driving the return lever follows a cam provided to an ASF control gear moving in conjunction with a feed roller, thereby causing the return lever to operate in conjunction with the feed roller. At the first position, the return lever enters into a path through which a sheet is passing, thereby preventing the top end of that sheet from improperly entering the inner region of the feed mechanism when that sheet is set. The return lever returns the leading end of the sheet newly placed to a predetermined sheet-top reference position by rotating from the first position to the second position. At the third position, the return lever is moved away so as not to disturb a sheet-separation operation and a transfer operation.

In recent years, a small printer for performing printing onto a postcard or a business card has been developed. Thus, the size of the feeding device used in such a small printer also becomes smaller. However, if the return lever mentioned in the description of the above conventional techniques, i.e., the return lever for returning the sheet simultaneously transferred with the sheet to be transferred to the sheet-holding portion is reduced in size, i.e., is shortened, the effect of the return lever cannot be achieved sufficiently. However, if the size of the feed mechanism is reduced while keeping the return lever unchanged, the top end of the return lever passes through an inner position than the outer circumferential surface of the feed roller when the return lever rotates. Thus, the top end of the return lever brings a part of the sheet up from the rear side of the sheet, causing irregularity of the sheet.

SUMMARY OF THE INVENTION

Therefore, it is an object of the present invention to provide a recording-medium returning mechanism and a recording apparatus including the same, and a medium returning mechanism and a liquid ejection apparatus including the same, which are capable of overcoming the above drawbacks accompanying the conventional art. The above and other objects can be achieved by combinations described in the independent claims. The dependent claims define further advantageous and exemplary combinations of the present invention.

According to the first aspect of the present invention, a recording-medium returning mechanism comprises: a feed roller, provided to a feed-roller shaft that is driven to be rotated, operable to feed a recording medium while coming into contact with the recording medium; a hopper including a holding portion operable to hold a plurality of recording media that are stacked, the hopper being located at a position that allows the recording media on the holding portion to come into contact with the feed roller while being pressed against the feed roller and a position that moves the recording media on the holding portion away from the feed roller; a separator operable to separate an uppermost one of the recording media on the holding portion from another one of the recording media that is fed simultaneously with the uppermost recording medium; and a return lever operable to return the another recording medium to the holding portion. The return lever has a length determined in such a manner that a top end of the return lever moves on a first trajectory when the return lever is rotated around the feed roller while no load is applied to the return lever in a longitudinal direction of the return lever and the length is enough to return the another recording medium to the holding portion. The first trajectory passes through an inside region of a circumferential surface of the feed roller. The top end of the return lever moves on a second trajectory when the return lever is rotated around the feed roller while the feed roller feds the recording medium. The second trajectory passes on a plane substantially the same as a plane extending from the circumferential surface of the feed roller because the recording medium exists.

The return lever has a length that allows the top end of the return lever normally moves on the first trajectory. Thus, in order to return the other recording medium to the holding portion with such a return lever having the top end moving on the first trajectory, the lower side of the recording medium to be fed to a recording process is pressed by the top end of the return lever, making that recording medium irregular.

However, according to the first aspect of the present invention, the top end of the return lever can move on the second trajectory that passes substantially the same plane as the plane extending from the circumferential surface of the feed roller because the recording medium exists. Thus, it is prevent the top end of the return lever from protruding from the rear side of the recording medium that is being fed to the recording process so as to push that recording medium. Therefore, that recording medium can be fed to the recording process while being kept flat, thus high-quality printing can be achieved.

The hopper may be arranged to bring the uppermost one of the recording media on the holding portion into contact with the feed roller while pushing the uppermost recording medium against the feed roller by being pivotally moved upward around a center of pivotal movement. In this case, the same advantageous effects as those mentioned above can be achieved with a more simple structure of the hopper.

The return lever may be rotatable around a return-lever rotation shaft that is always forced in such a manner that the top end of the return lever moves on the first trajectory, the return-lever rotation shaft being movable away from the feed roller to allow the top end of the return lever to move on the second trajectory, when the feed roller feed the recording medium.

According to this arrangement, when the feed roller is feeding the recording medium, a downward pressing force is applied to the top end of the return lever by the rear side of the recording medium thus fed. This pressing force moves the return-lever rotation shaft away from the feed roller. Thus, the top end of the return lever can move on the second trajectory that passes through substantially the same plane as the plane extending from the circumferential surface of the feed roller.

The return-lever rotation shaft may be rotated in conjunction with a cam mechanism operable to pivotally move the hopper.

In this case, the rotation of the return-lever rotation shaft and the pivotal movement of the cam mechanism for pivotally move the hopper are caused by the same driving source. Thus, the structure of the recording-medium returning mechanism can be made simpler.

The return lever may contract when the feed roller is feeding the recording medium so as to allow the top end of the return lever move on the second trajectory.

According to this arrangement, when the feed roller is feeding the recording medium, the rear side of the recording medium thus fed applies the downward pressing force to the top end of the return lever. Since this pressing force causes the return lever to contract, the top end can move on the second trajectory that passes on substantially the same plane as the plane extending from the circumferential surface of the feed roller.

The return lever may include a lever-base portion and a lever-top portion. The lever-top portion may be forced in such a manner that the top end of the return lever always protrudes to move on the first trajectory, and be able to be moved toward the lever base to allow the top end of the return lever to move on the second trajectory while the feed roller feeds the recording medium.

According to this arrangement, while no recording medium exists and the downward pressing force does not act on the top end of the return lever, the top end moves on the first trajectory that passes through the inside region of the circumferential surface of the feed roller because the lever-top portion is forced. However, while the recording medium exists and the downward pressing force acts on the top end of the return lever, the lever-top portion is moved toward the lever-base portion and therefore the top end of the return lever can move on the second trajectory.

According to the second aspect of the present invention, a recording apparatus comprises any one of recording-medium returning mechanisms mentioned above. Thus, since the top end of the return lever can move on the second trajectory that passes through substantially the same plane as the plane extending from the circumferential surface of the feed roller because of the recording medium, protrusion of the top end of the return lever from the rear side of the recording medium that is being fed to the recording process can be prevented. Therefore, the recording medium can be fed to the recording process while being kept flat, providing a high printing quality.

According to the third aspect of the present invention, a medium returning mechanism comprises: a feed roller, provided to a feed-roller shaft that is driven to be rotated, operable to come into contact with a medium and feed the medium; a hopper including a holding portion operable to hold a plurality of media that are stacked, the hopper being located at a position that allows the media on the holding portion to come into contact with the feed roller while being pressed against the feed roller and a position that moves the media on the holding portion away from the feed roller; a separator operable to separate an uppermost one of the media on the holding portion from another one of the media that is fed simultaneously with the uppermost medium; and a return lever operable to bring the another medium to the holding portion. The return lever has a length determined in such a manner that a top end of the return lever moves on a first trajectory when the return lever is rotated around the feed roller while no load is applied to the return lever in a longitudinal direction of the return lever and the length is enough to bring the another medium back to the holding portion. The first trajectory passes through an inside region of a circumferential surface of the feed roller. The top end of the return lever moves on a second trajectory when the return lever is rotated around the feed roller while the feed roller feds the medium. The second trajectory passes on a plane substantially the same as a plane extending from the circumferential surface of the feed roller because the medium exists.

According to the fourth aspect of the present invention, a liquid ejection apparatus comprises a medium returning device as mentioned above.

The summary of the invention does not necessarily describe all necessary features of the present invention. The present invention may also be a sub-combination of the features described above. The above and other features and advantages of the present invention will become more apparent from the following description of the embodiments taken in conjunction with the accompanying drawings.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Prior to the description of the characteristic structure of the present invention, a feed mechanism of an ink-jet printer to which a recording-medium returning device of the present invention can be applied is described.

Figure 1:
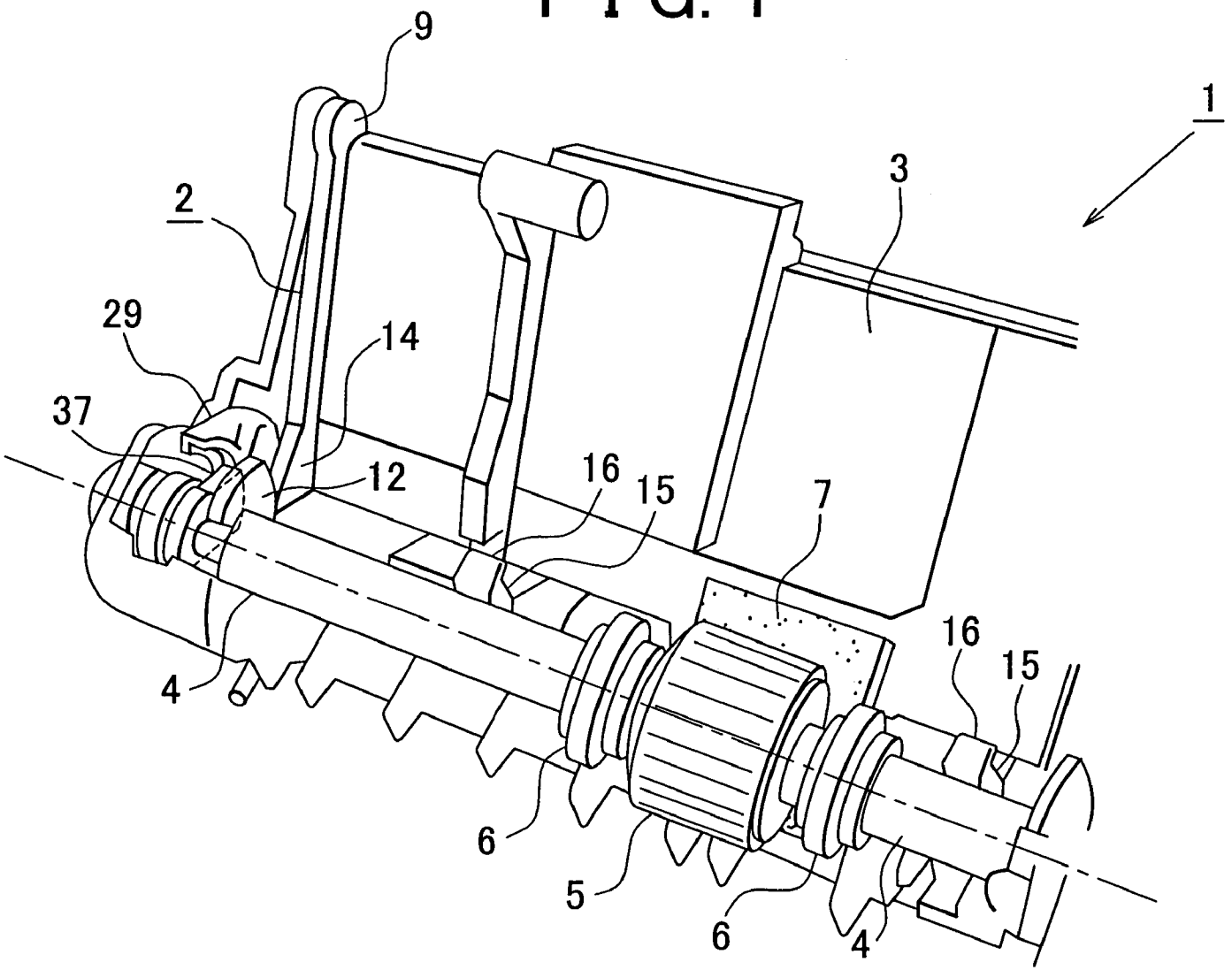
FIG. 1 is a perspective view of a feed mechanism for an ink-jet printer, to which the present invention can be applied.
Figure 2:
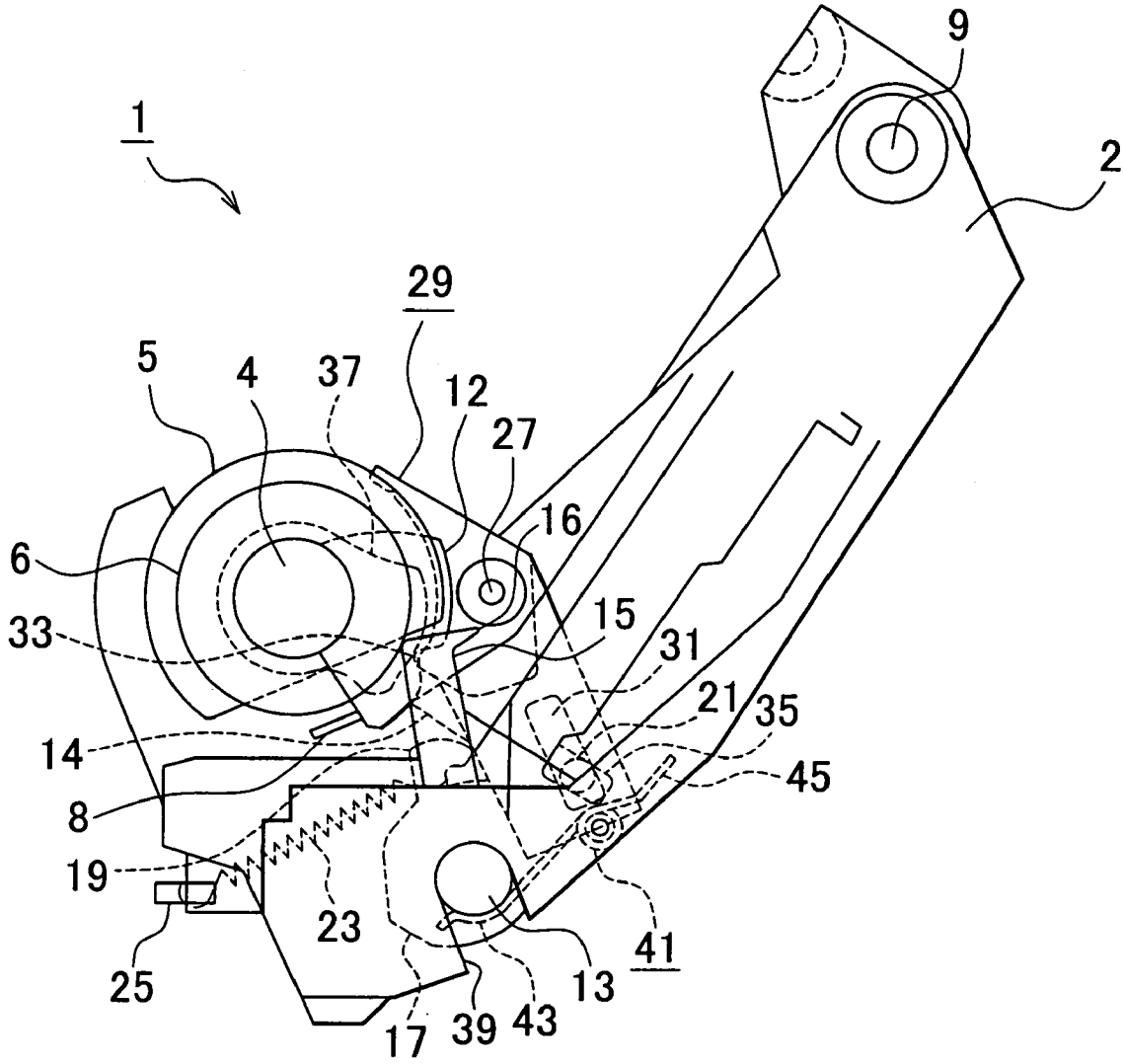
FIG. 2 is a left side view of the feed mechanism.
Figure 3:
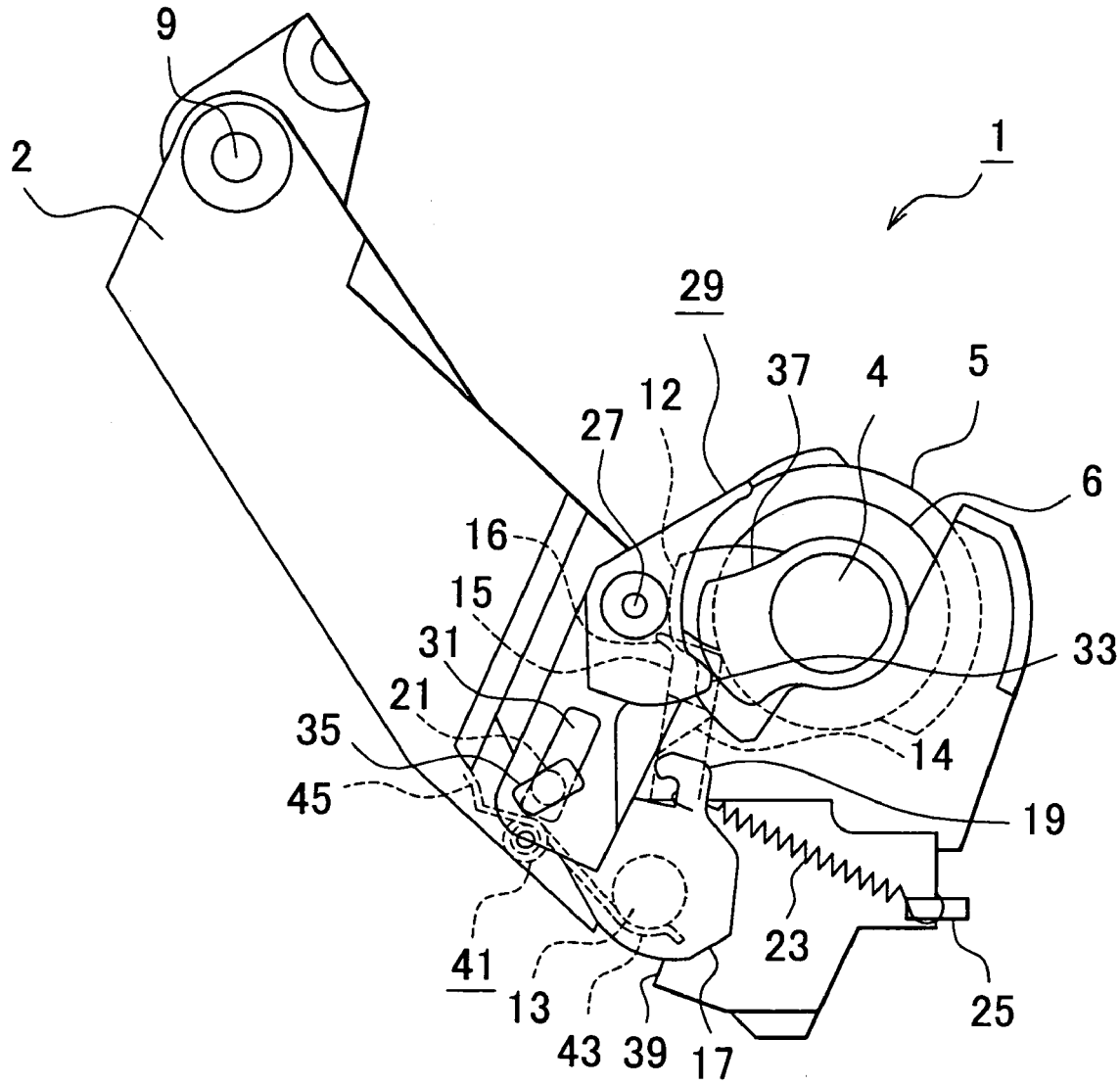
FIG. 3 is a right side view of the feed mechanism.
Figure 4:
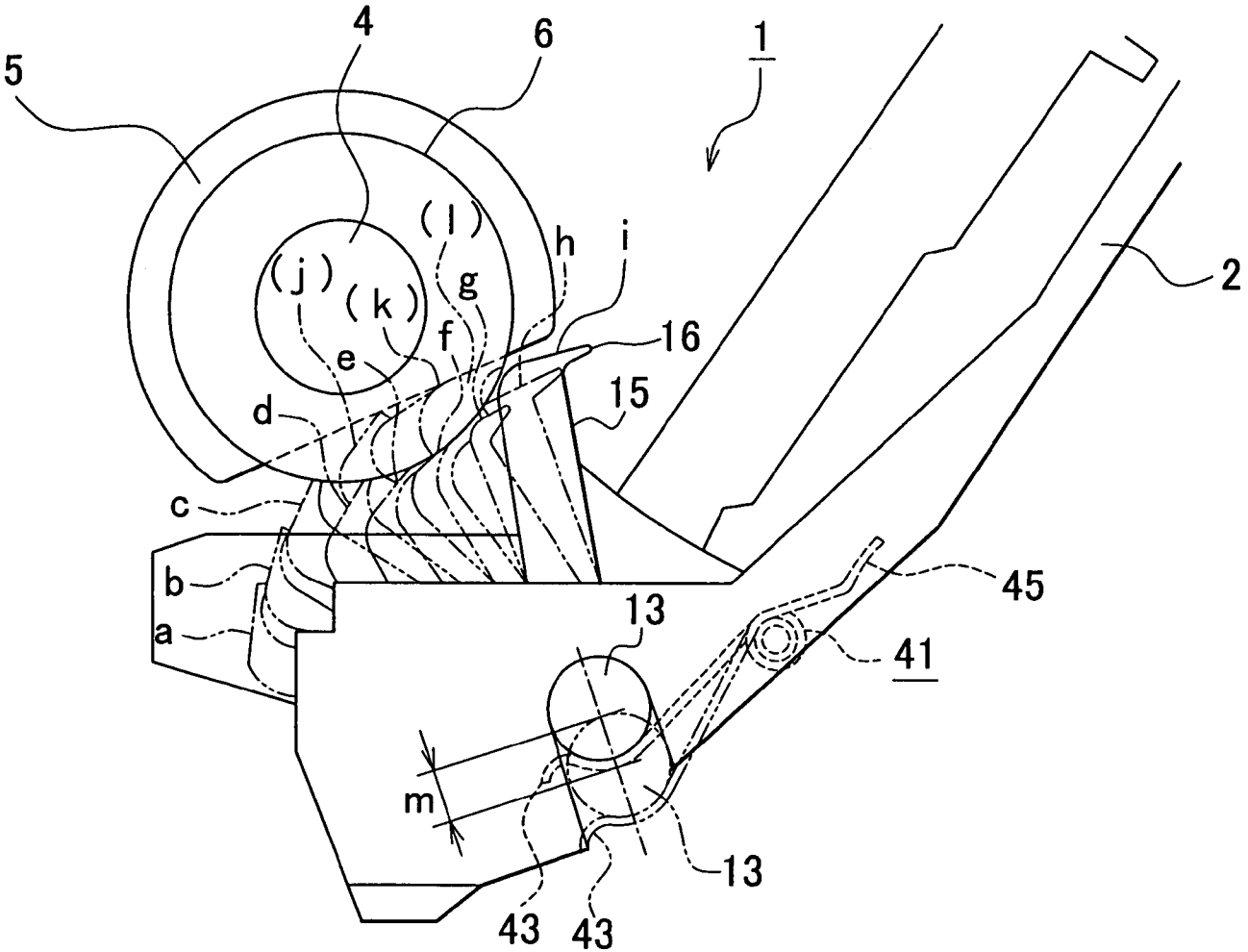
FIG. 4 is a left side view of the feed mechanism, showing a trajectory of a return lever when the return lever performs a return operation.
Figure 5:
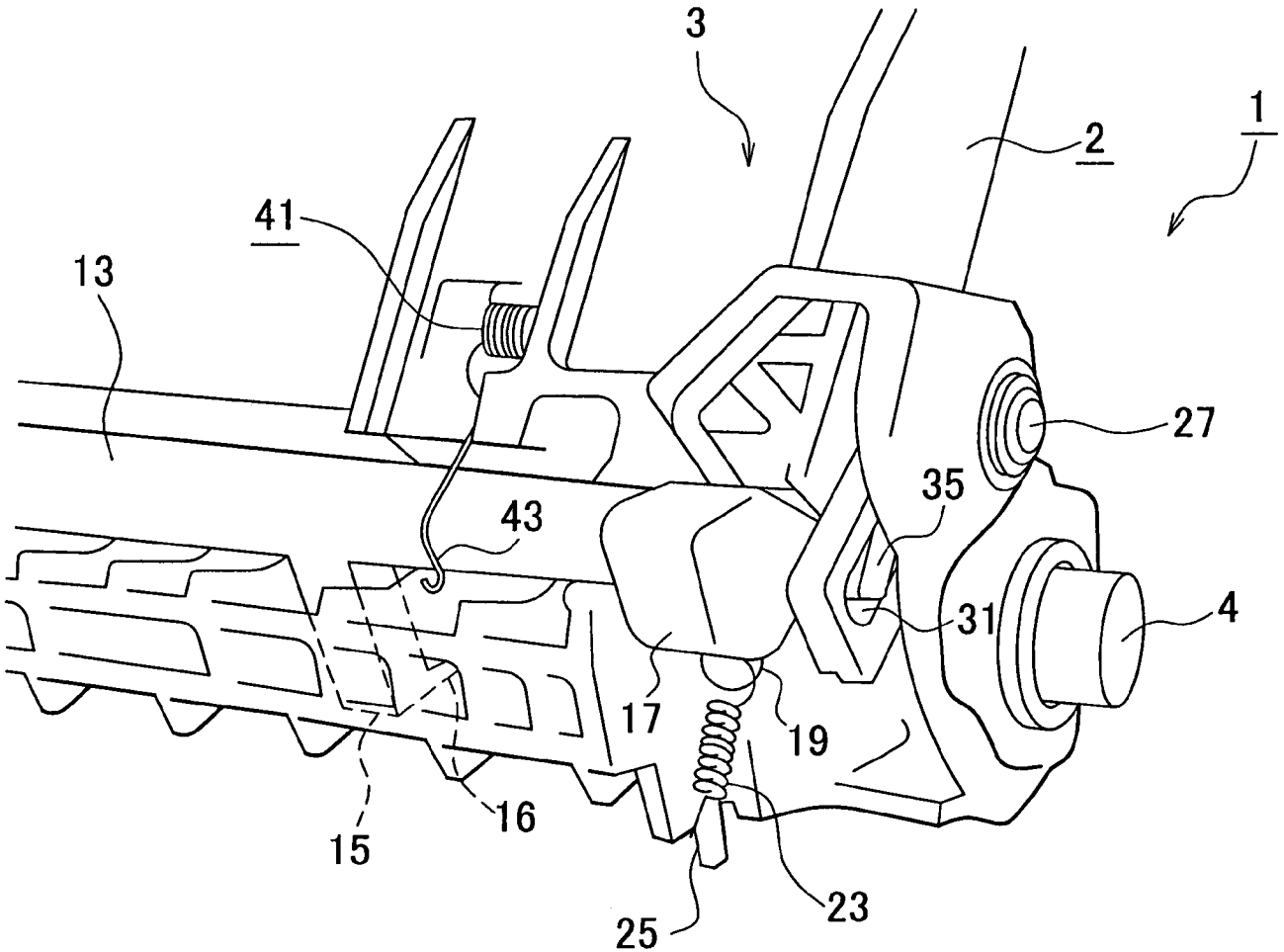
FIG. 5 is a perspective view of the feed mechanism, seen from beneath.
Figure 6B:
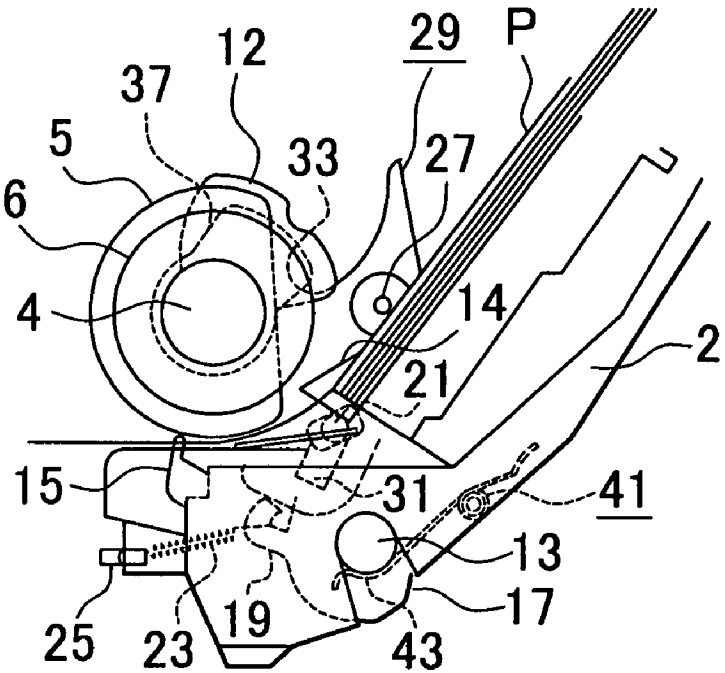
FIGS. 6A-6D are side views of the feed mechanism, showing its operations from a feed operation to the return operation in a stepwise manner.
Figure 7:
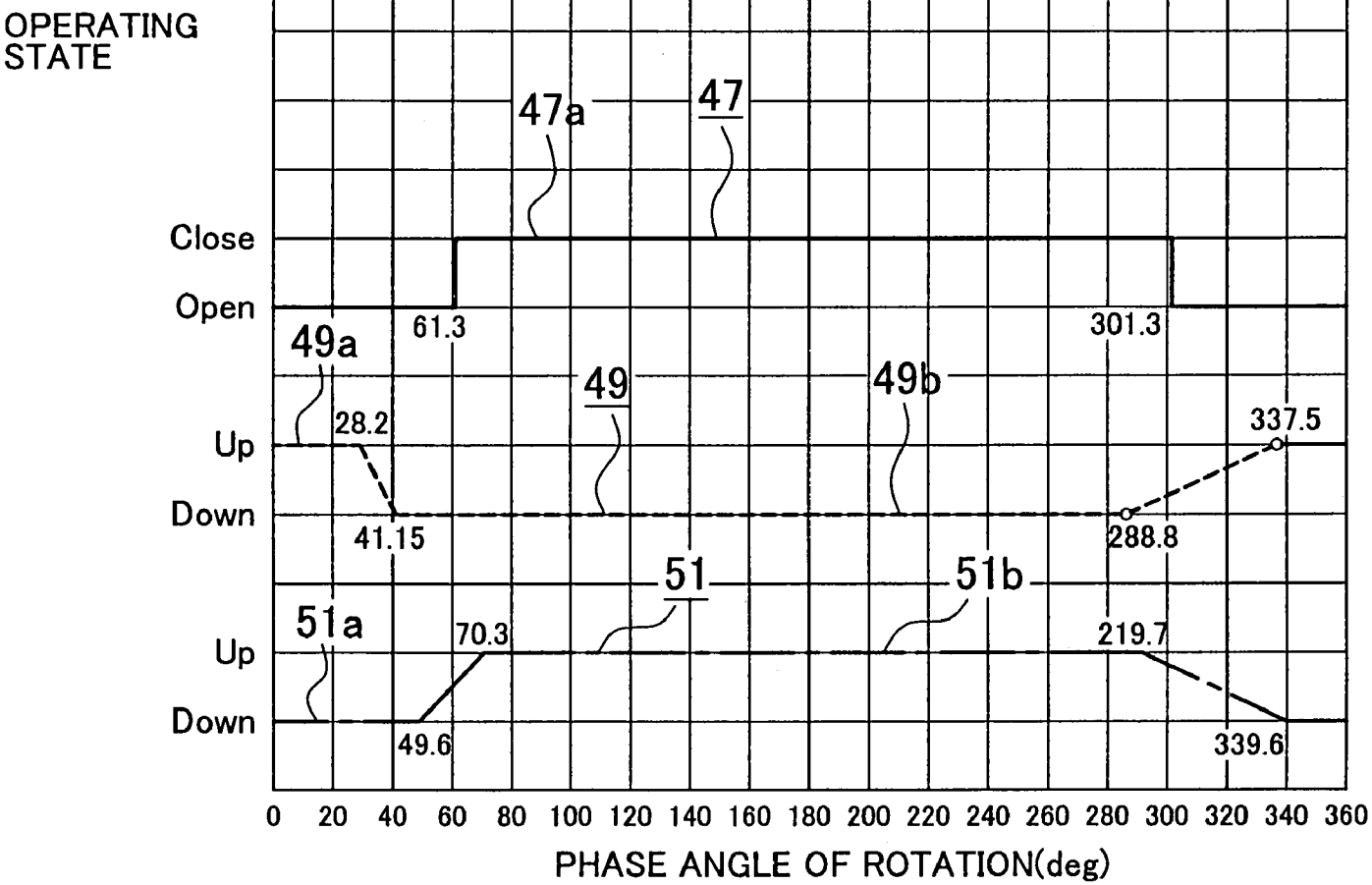
FIG. 7 is a time chart showing a position of a return-lever rotation shaft and an operating state of a hopper.
Figure 8:
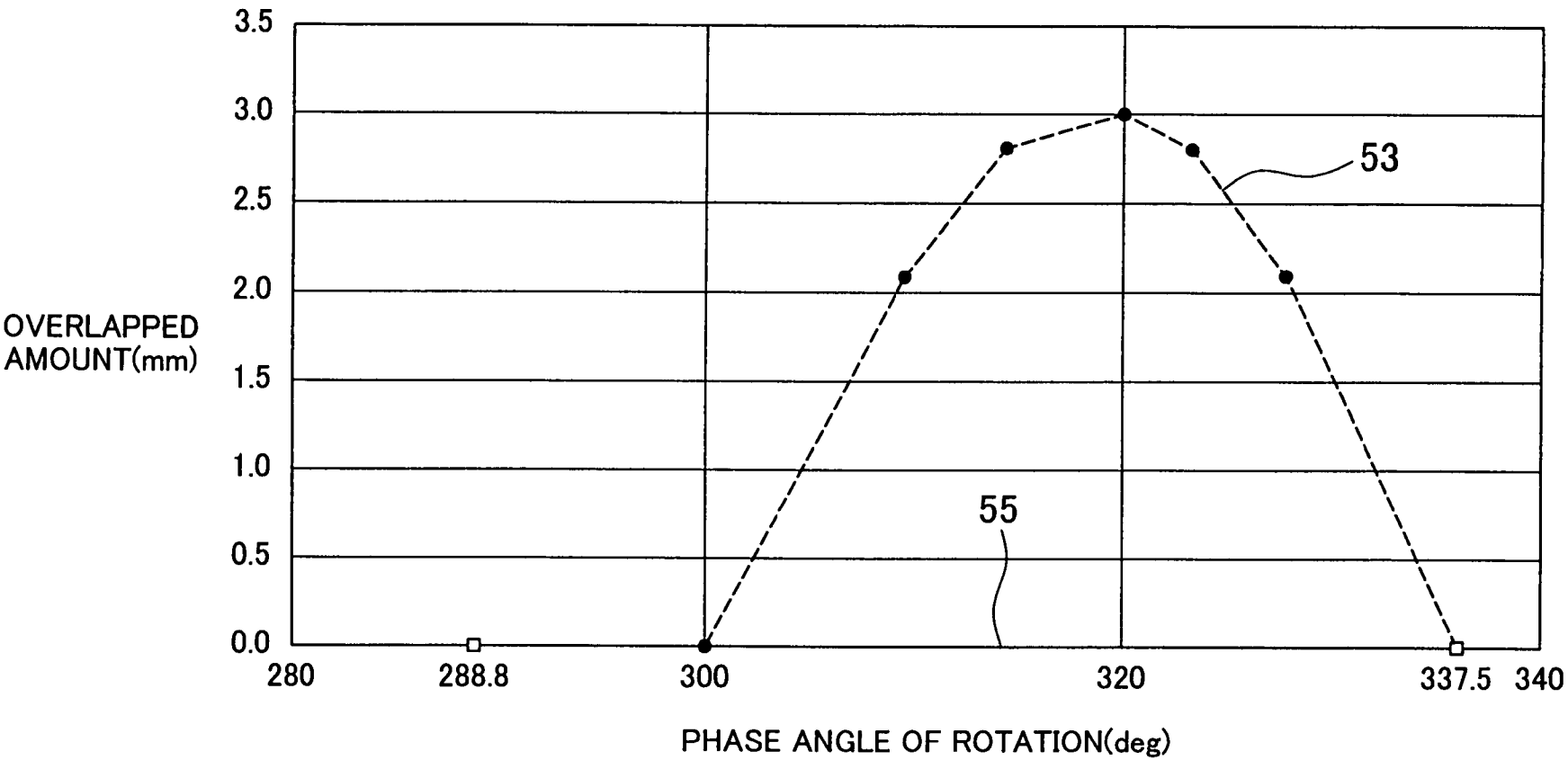
FIG. 8 is a graph showing an overlapped amount of a top end of the return lever and the feed roller.

FIG. 1 is a perspective view of the feed mechanism 1 of the ink-jet printer to which the recording-medium returning mechanism according to the present invention can be applied; FIG. 2 is a perspective left side view thereof; and FIG. 3 is a perspective right side view thereof. FIG. 4 is a left side view of the feed mechanism, showing a trajectory of a return lever when the return lever performs a return operation for a recording medium. FIG. 5 is a perspective view of the feed mechanism, seen from beneath at an angle. FIG. 6 is a left side view showing operations from an operation of feeding the recording medium to the return operation. FIG. 7 is a time-chart showing a nip state where the feed roller nips the recording medium, a positional state of the rotation shaft of the return lever and an operating state of a hopper. FIG. 8 is a graph showing how much depth does the top end of the return lever enter inward when the return lever is rotated.

In the present specification, it is assumed that a direction to which the recording medium is transferred is "forward" and a direction opposite to that direction is "backward".

The feed mechanism 1 shown in FIG. 1 may be used in a recording apparatus such as an ink-jet printer, for performing recording onto a relatively small recording medium such as a postcard or a business card, or a liquid ejection apparatus for emitting liquid onto a relatively small medium in a similar manner. As compared with a feed mechanism used for a recording apparatus that is typically used in an office for performing printing on a recording medium of A4 or B5-size Japanese Industrial Standard, the feed mechanism 1 has small dimensions as a whole. It should be noted that a feed mechanism for the liquid ejection apparatus has substantially the same structure as that for the recording apparatus, and therefore only the feed mechanism for the recording apparatus is described below.

The feed mechanism 1 for the recording apparatus includes a hopper 2 having a holding portion 3 that can retain a plurality of recording media P that are stacked, and also includes a feed roller 5 having a D-shape cross section seen from the side, that is supported in a rotatable manner by a feed-roller shaft 4 provided right in front of the holding portion 3. The feed mechanism 1 further includes a separation pad 8 (shown in FIG. 2) at a position opposed to the feed roller 5. The separation pad 8 separates the uppermost recording medium P from the other recording medium/media so as to allow only the uppermost one to be transferred forward, in a case where two or more recording media P on the holding portion 3 are going to be fed by the feed roller 5 (this state is called as "simultaneous transfer" in this specification).

On both sides of the feed roller 5, auxiliary rollers 6 are provided that can freely rotate in order to realize stable feed of the recording medium P. More specifically, the auxiliary rollers 6 are arranged in such a manner that, in a case where a straight portion of the feed roller 5 having a D-shape seen from the side faces the separation pad 8 (as shown in FIG. 2) and a transfer roller (not shown) arranged in front of the feed roller 5 continues to transfer the recording medium P in a recording process, the recording medium P is guided while not coming into contact with the feed roller 5 but comes into contact with the auxiliary rollers 6. Thus, the stable transfer can be achieved with a reduced transfer resistance.

The hopper 2 is always forced obliquely upward by an action of a spring (not show). By cooperation of a hopper-operating cam 12 provided on the feed-roller shaft 4 and a cam-follower 14 formed in the hopper 2, the top end of the hopper 2 is pivotally moved around the hopper-rotation shaft 9 in such a manner that that top end goes down when no feed operation is performed and goes up when a feed operation is performed. When the top end of the hopper 2 is moved up, the uppermost recording medium P in the holding portion 3 comes into contact with the circumferential surface of the feed roller 5 while being pressed against the feed roller 5. As shown in FIG. 1, a friction member 7 is provided at the top end of the hopper 2, which prevents the recording media that are stacked on the hopper 2 from coming unstuck.

As shown in FIGS. 2 and 3, a return-lever rotation shaft 13 is provided in a rotatable manner below the feed-roller shaft 4 in parallel to the feed-roller shaft 4. Two return levers 15 (shown in FIGS. 1-3) are provided to the return-lever rotation shaft 13, which act to return one or more recording media P other than the uppermost recording medium P to the holding portion 3, when two or more recording media P are simultaneously fed by the feed roller 5 while being stacked.

As shown in FIGS. 2 and 3, a rotatable plate 17 is secured to the return-lever rotation shaft 13. The rotatable plate 17 is provided with a spring latch portion 19 and a latch projection 21. One end of a tension spring 23 is latched to the spring latch portion 19, while the other end thereof is latched to a spring latch piece 25 formed in a base frame of the feed mechanism 1. The rotatable plate 17 is always forced to rotate toward a state in which the return lever 15 is ready to start a return action, i.e., toward an initial state (in a counterclockwise direction in FIG. 2), by an action of the tension spring 23.

Near the rotational plate 17, a cam-action plate 29 is provided that can rotate around a rotation axis 27 provided in the base frame of the feed mechanism 1. The cam-action plate 29 is provided with an elongate hole 31 below the rotation axis 27 and a cam-follower 33 near the rotation axis 27. Through the elongate hold 31 is inserted the latch protrusion 21 formed on the rotatable plate 17. A turn button 25 prevents the latch protrusion 21 from being disengaged from the elongate hole 31.

The cam-follower 33 formed on the cam-action plate 29 is located at a position at which the cam-follower 33 can come into contact with a lever-operating cam 37 provided on the feed-roller shaft 4. When the feed-roller shaft 4 rotates, the cam-action plate 29 is rotated around the rotation axis 27 by cooperation of the lever-operating cam 37 and the cam-follower 33 as described in detail later. Thus causes the rotation of the rotatable plate 17, thus rotating the return lever 15 to return the recording medium that is simultaneously transferred with the uppermost recording medium to the holding portion 3.

As shown in FIG. 2, an end of the return-lever rotation shaft 13 is placed within an open bearing portion 39 having a downward opening, thereby upward movement of that end of the return-lever rotation shaft 13 is restrained. The end of the return-lever rotation shaft 13 is also supported by one end 43 of a twisted coil spring 41 while being forced upward (see FIG. 5). The other end of the twisted coil spring 41 is secured. Due to such a structure, when a downward force (a force in a direction in which the return-lever shaft 13 is removed from the open bearing portion 39) acts on the return lever 15, the return-lever rotation shaft 13 can be moved down against the upward force applied by the end 32 of the twisted coil spring 41.

The recording-paper returning mechanism of the present invention has the aforementioned structure, and the operation thereof is described below, referring to FIG. 4 and FIGS. 6A-8. In the graph of FIG. 7, the horizontal axis represents a phase angle of rotation of the feed-roller shaft 4. Moreover, solid line 46 represents a state where the feed roller 5 and the separation pad 8 are nipped and a state where they are not nipped, broken line 49 represents a position of the return lever 15, and dashed line 51 represents an operating state of the hopper 2. In FIG. 8, the horizontal axis represents a phase angle of rotation of the feed-roller shaft 4. Furthermore, broken line 53 represents the depth of the point through which the top end of the return lever 15 passes from a surface extending from the circumferential surface of the feed roller 5 (this depth is called as an overlapped amount) when no recording medium P is fed, and solid line 55 represents the overlapped amount when the recording medium P is fed.

In the state where the cam-follower 14 is in contact with the hopper-operating cam 12, as shown in FIG. 2, the hopper 2 is placed in a pivoted-down state (shown with 51*a* in FIG. 7) in which the hopper 2 was pivotally moved down. In this state, the uppermost recording medium in the holding portion 3 is not in contact with the feed roller 5. In this state, the return lever 15 is located at its upper position, i.e., "UP" position (shown with 49*a* in FIG. 7) by the action of the twisted coil spring 41.

Figure 6A:
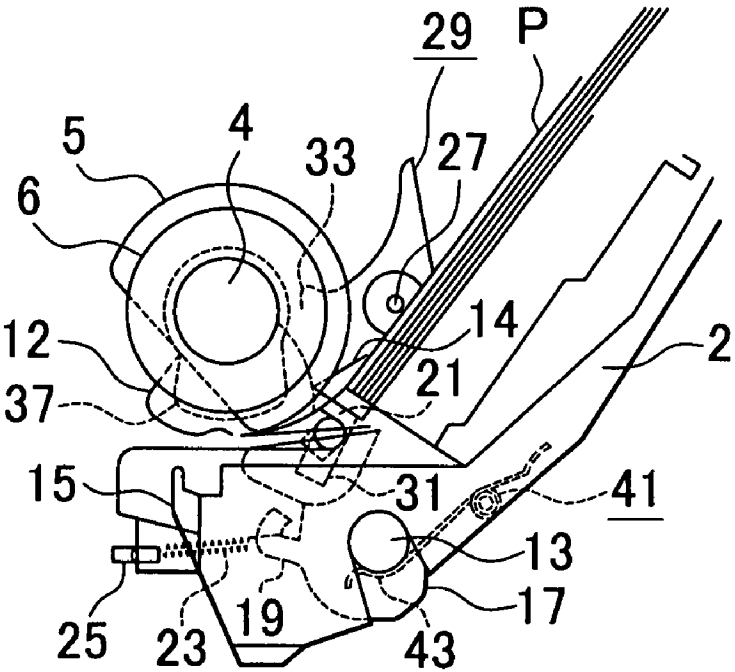
Figure 6D:
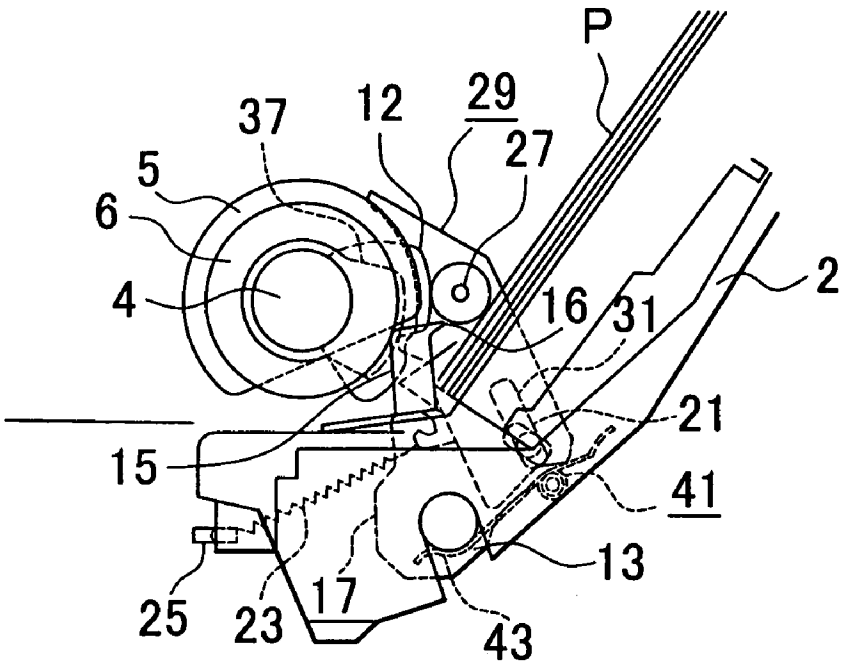

As shown in FIG. 6A, when the hopper-operating cam 12 was rotated by the rotation of the feed-roller shaft 4, the cam-follower 14 disengages from the hopper-operating cam 12 and thus the hopper 2 is pivoted upward (shown with 51*b* in FIG. 7), thereby the uppermost recording medium P comes into contact with the surface of the feed roller 5. Since the feed roller 5 is rotated in a clockwise direction in FIG. 6A, it starts to feed the recording medium P. However, two or more recording media may be simultaneously transferred by a friction force generated between the recording media. Therefore, the feed roller 5 and the separation pad 8 (not shown in FIGS. 6A-6D) are placed in a state in which the recording medium is nipped between them (this state is shown with 47*a* in FIG. 7) so as to feed only the uppermost sheet forward by the action of the separation pad 8.

When the rotation of the feed-roller shaft 4 progresses, as shown in FIG. 6B, the lever-operating cam 37 comes into contact with the cam-follower 33 of the cam-action plate 29, thereby the cam-action plate 29 starts to rotate around the rotation shaft 27 in a counterclockwise direction in FIG. 6B. With this rotation of the cam-action plate 29, the latch protrusion 21 formed on the rotatable plate 17 is guided downward to the right in FIG. 6B, within the elongate hole 31 formed in the cam-action plate 29 and the rotatable plate 17 is simultaneously rotated around the return-lever rotation shaft 13 in the clockwise direction in FIG. 6B against the pulling force of the tension coil spring 23. Thus, the return lever 15 starts to rotate in the clockwise direction in FIG. 6B.

If no recording paper P is fed, the top end 16 of the return lever 15 receives no load at the start of the clockwise rotation of the return lever 15. Thus, the position of the return-lever rotation shaft 13 does not change and therefore the top end 16 of the return lever 15 moves along the first trajectory, a-b-c-j-k-l-i in FIG. 4. This first trajectory passes through an inside region of a virtual surface extending from the circumferential surface of the feed roller 5, as is apparent from FIG. 4 that shows the feed mechanism 1 from the side thereof, and the top end 16 of the return lever 15 and the feed roller 5 are overlapped when see from the side. The condition of this overlapping is shown with broken line 53 in FIG. 8. The first trajectory is a path of the top end 16 of the return lever 15 because no recording medium P exists around the feed roller 5.

Figure 6C:
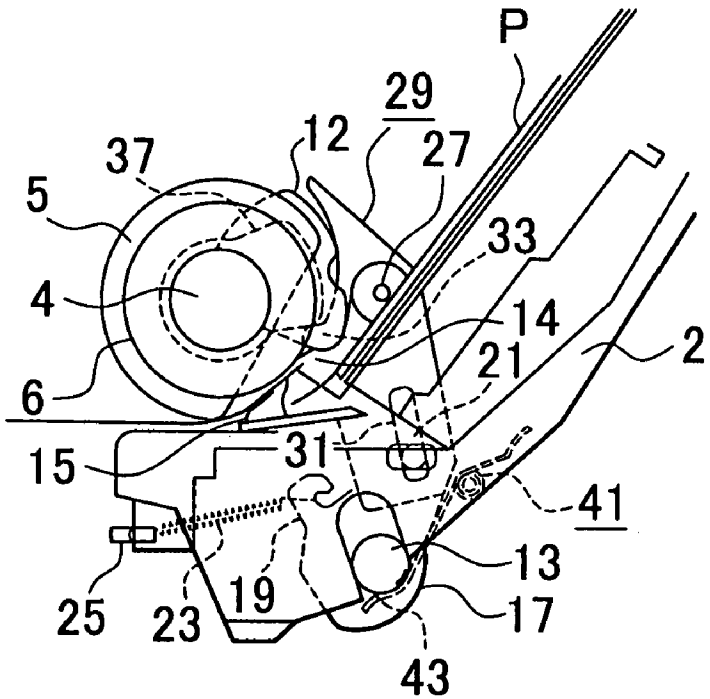

Referring to FIG. 6C, while the recording medium P is being fed, it passes substantially on the circumferential surface of the feed roller 5 and the plane extending from the circumferential surface of the feed roller 5. Thus, when the top end 16 of the return lever 15 passes near the feed roller 5, it comes into contact with the reverse side of the recording paper P and receives a pressing force that acts downward in FIG. 6C. Since the return-lever rotation shaft 13 is arranged to be movable toward a direction toward which the open bearing portion 39 is opened in the present embodiment, when receiving the above pressing force, the return-lever rotation shaft 13 is moved downward as shown in FIG. 6C, i.e., is placed in a "DOWN" state (state shown with 40*b* in FIG. 7), against the upward force applied by the end 43 of the twisted coil spring 41. Thus, the top end 16 of the return lever 15 is also moved downward.

In other words, while the recording medium P is being fed, the position of the return-lever rotation shaft 13 is moved downward by a distance m (see FIG. 4). Therefore, the top end 16 of the return lever 15 moves along the second trajectory, a-b-c-d-e-f-g-h-i, that runs on substantially the same plane as the plane extending from the circumferential surface of the feed roller 5. When the top end 16 of the return lever 15 moves along the second trajectory, the overlapped amount of the feed roller 5 and the top end 16 of the return lever 15 becomes substantially zero as shown with solid line 55 in FIG. 8.

In a case where the return-lever rotation shaft 13 is not moved as in the conventional technique, the top end 16 of the return lever 15 moves along the first trajectory. Thus, the top end 16 of the return lever 15 pushes the recording medium P into the inside of the plane extending from the circumferential surface of the feed roller 5, causing irregularity of the recording medium P. However, according to the present embodiment, since the top end 16 of the return lever 15 moves along the second trajectory while the recording medium P is being fed, the generation of the irregularity of the recording medium P can be prevented.

In a case where two or more recording media P are simultaneously transferred at the start of the feed operation, the top end 16 of the return lever 15 is rotated in the clockwise direction while engaging with the leading end of the recording medium that is other than the recording medium to be fed, thus returning the recording medium other than the recording medium to be fed to the holding portion 3. In this case, the top end 16 of the return lever 15 moves back to have its original length, as shown with the state i of the return lever 15. Thus, the top end 16 of the return lever 15 can push the recording medium other than the recording medium to be fed, backward sufficiently.

As described above, although the feed mechanism for a recording apparatus such as an ink-jet printer, for performing printing onto a relatively small recording medium such as a postcard or a business card, is designed to have small dimensions as a whole, the return lever 15 can have an enough length to push a recording medium simultaneously fed together with the recording medium to be fed to a recording process, backward sufficiently because the structure for moving the top end of the return lever 15 away is employed.

Figure 9:
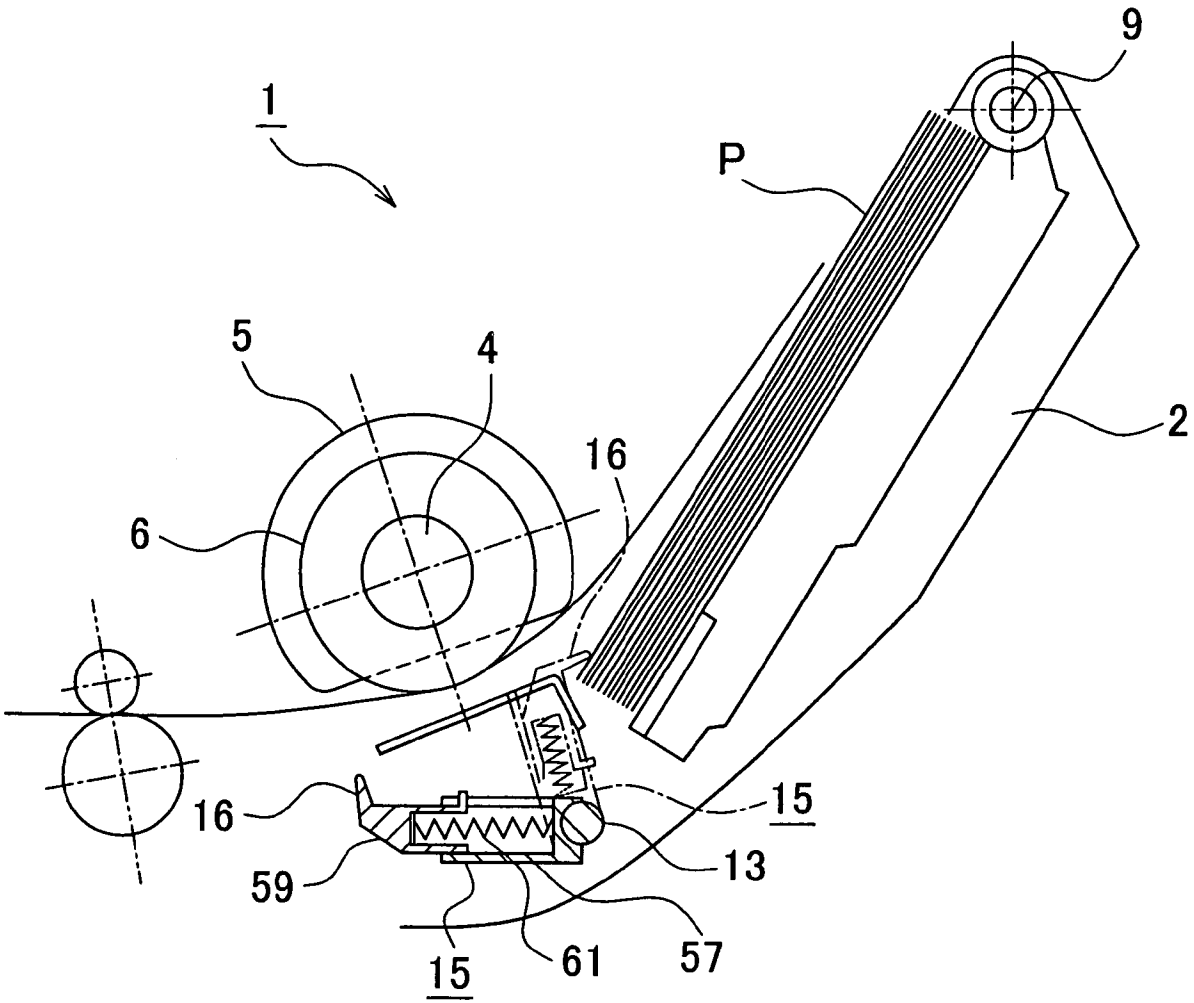
FIG. 9 is a side view of the feed mechanism according to another embodiment of the present invention.

Next, another embodiment of the present invention is described referring to FIG. 9. In this embodiment, the return-lever rotation shaft 13 is fixed and therefore it cannot move in the manner mentioned in the above embodiment. The return lever 15 of the present embodiment can contract so as to allow its top end 16 move on the second trajectory when the feed roller 5 is feeding the recording medium P.

More specifically, the return lever 15 is formed by a lever-base portion 57 and a lever-top portion 59 that can contract to be nested in the lever-base portion 57. A compression spring 61 is accommodated within the lever-top portion 59 and the lever-base portion 58, which forces the lever-top portion 59 to always protrude from the lever-base portion 57. This arrangement enables the lever-top portion 59 to contract toward the inside of the lever-base portion 57 against the force applied by the compression spring 61, when load acts on the lever-top portion 59 in a direction toward the lever-base portion 57.

As described above, in the present embodiment, the top end 16 of the return lever 15 can also move toward the lever-base portion 57 by contraction of the lever-top portion 59. Thus, while the feed roller is feeding the recording medium, the return lever 15 contracts by a downward pressing force applied to the top end 16 of the return lever 15 by the rear side of the recording medium. Therefore, the top end 16 can move on the second trajectory that passes through substantially the same plane as the plane extending from the circumferential surface of the feed roller 5.

Although the present invention has been described by way of exemplary embodiments, it should be understood that those skilled in the art might make many changes and substitutions without departing from the spirit and the scope of the present invention which is defined only by the appended claims.

What is claimed is:

1. A recording-medium feeding apparatus comprising:

a holding portion for holding a plurality of recording media;

a feed roller for feeding on a feeding path a recording medium from said holding portion;

a rotation shaft facing said feed roller;

an urging member for urging said rotation shaft toward said feed roller;

a separator for separating one of said recording media contacting with said feed roller from the other recording media; and a return lever linked to said rotation shaft for bringing said other recording media back to said holding portion, said return lever being positioned off the feeding path of the recording medium at least at the time of starting the feeding of the recording medium, wherein said rotation shaft rotates to cause said return lever to come into contact with a surface of the recording medium while feeding the recording medium, said rotation shaft moves away from said feed roller by a force applied by the surface of the recording medium after said return lever comes into contact with the surface of the recording medium, and said rotation shaft moves toward said feed roller by a force applied by said urging member when said return lever brings the other recording media back to said holding portion.

2. A recording-medium recording apparatus, comprising the recording-medium feeding apparatus as claimed in claim 1.

3. A recording-medium returning mechanism comprising:

a return lever for returning a recording medium upstream in a medium feeding direction;

a return-lever rotation shaft serving as a rotation shaft of said return lever, said return-lever rotation shaft being urged toward a feed roller for feeding the recording medium; and a bearing portion for holding said return-lever rotation shaft and allowing said return-lever rotation shaft to move away from the feed roller.

4. A recording-medium recording apparatus:

returning by a return lever a recording medium upstream in a medium feeding direction;

urging a return-lever rotation shaft serving as a rotation shaft of said return lever toward a feed roller for feeding the recording medium;

holding by a bearing portion said return-lever rotation shaft; and moving with said bearing portion said return-lever rotation shaft away from the feed roller.

* * * * *